US005791665A

United States Patent [19]

Mayer, II

[11] Patent Number: 5,791,665

[45] Date of Patent: Aug. 11, 1998

[54] ROLLER SKATE WITH BRAKE

[75] Inventor: Bruce A. Mayer, II, Mendham, N.J.

[73] Assignee: GBG Mayer Inc., Livingston, N.J.

[21] Appl. No.: 677,711

[22] Filed: Jul. 10, 1996

Related U.S. Application Data

[63] Continuation-in-part of Ser. No. 657,967, Jun. 5, 1996, which is a continuation-in-part of Ser. No. 472,382, Jun. 7, 1995, Pat. No. 5,685,550.

[51] Int. Cl.[6] ..... A63C 17/04

[52] U.S. Cl. ..... 280/11.22; 280/11.27

[58] Field of Search ..... 280/843, 11.2, 280/11.22, 11.27, 11.28, 87.041, 87.042

[56] References Cited

U.S. PATENT DOCUMENTS

| | | | |
|---|---|---|---|
| 2,166,767 | 7/1939 | Petermann | 280/11.22 |
| 2,552,987 | 5/1951 | Loertz, Jr. | 280/11.28 |
| 2,644,692 | 7/1953 | Kahlert | 280/11.28 |
| 3,729,207 | 4/1973 | Reynolds | 280/11.2 |
| 4,153,263 | 5/1979 | Yoshimoto | 280/11.19 |
| 4,272,090 | 6/1981 | Wheat | 280/11.28 |
| 4,382,605 | 5/1983 | Hegna | 280/11.22 |
| 4,412,685 | 11/1983 | Szamek | 280/11.19 |
| 5,085,445 | 2/1992 | Boyden | 280/11.22 |
| 5,135,244 | 8/1992 | Allison | 280/11.28 |
| 5,207,454 | 5/1993 | Blankenburg et al. | 280/843 |
| 5,246,238 | 9/1993 | Brown | 280/11.2 |
| 5,312,165 | 5/1994 | Spletter | 301/5.23 |
| 5,342,071 | 8/1994 | Soo | 280/11.28 |
| 5,397,138 | 3/1995 | Mangelsdorf | 280/11.2 |
| 5,405,156 | 4/1995 | Gonella | 280/11.28 |
| 5,409,265 | 4/1995 | Douglass | 280/843 |
| 5,441,287 | 8/1995 | Tang | 280/11.28 |
| 5,478,094 | 12/1995 | Pennestri | 280/11.2 |
| 5,486,011 | 1/1996 | Nelson | 280/11.2 |
| 5,511,805 | 4/1996 | McGrath | 280/11.2 |
| 5,524,911 | 6/1996 | Cochimin | 280/7.1 |
| 5,553,874 | 9/1996 | Schooten et al. | 280/11.28 |
| 5,566,958 | 10/1996 | Sinelnikov et al. | 280/11.22 |
| 5,586,777 | 12/1996 | Wolf | 280/11.22 |
| 5,588,658 | 12/1996 | Perner et al. | 280/11.27 |

FOREIGN PATENT DOCUMENTS

| | | | |
|---|---|---|---|
| 2070179 | 4/1992 | Canada . | |
| 2144559 | 10/1995 | Canada . | |
| 2151210 | 12/1995 | Canada . | |
| 2151787 | 12/1995 | Canada . | |
| 2724396 | 11/1978 | Germany | 280/11.19 |
| 2903174 | 7/1980 | Germany | 280/843 |
| 2160780 | 1/1986 | United Kingdom | 280/11.2 |
| 82/10251 | 6/1992 | WIPO | 280/11.22 |

*Primary Examiner*—Brian L. Johnson
*Assistant Examiner*—Frank Vanaman
*Attorney, Agent, or Firm*—Whitman Breed Abbott & Morgan LLP

[57] ABSTRACT

A roller skate of the in-line wheel type having spherically shaped wheels and wherein the toe and heel wheels are disposed at a higher elevation than the interior wheels. The interior wheels are pivotally mounted so the skater's boot can pivot to maintain either the toe wheel and the interior wheels or the heel wheel and the interior wheels in contact with the skating surface. On turns the interior wheels provide a braking action.

13 Claims, 4 Drawing Sheets

FIG. 3
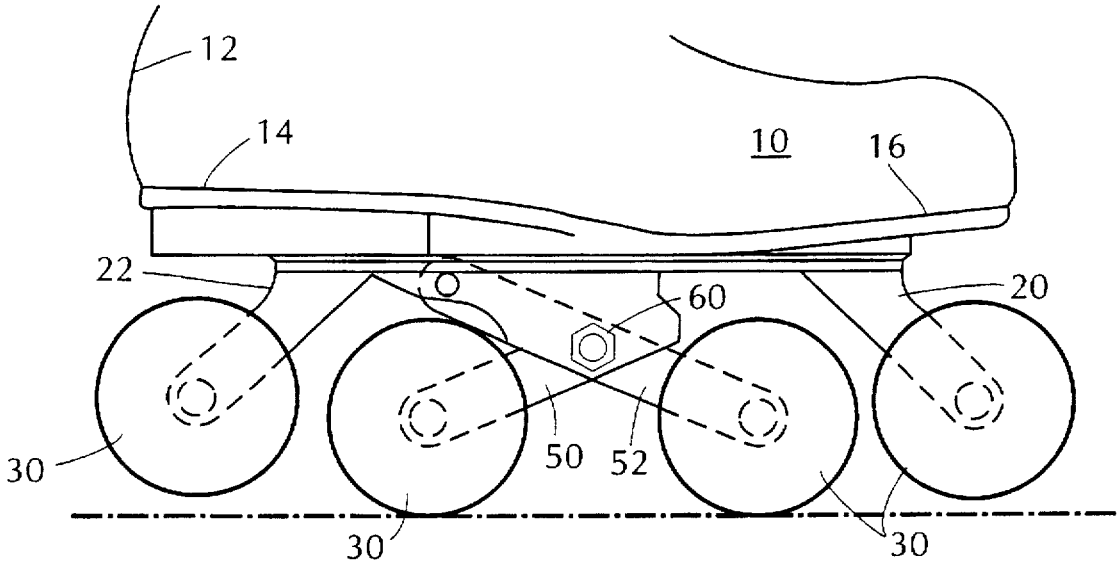
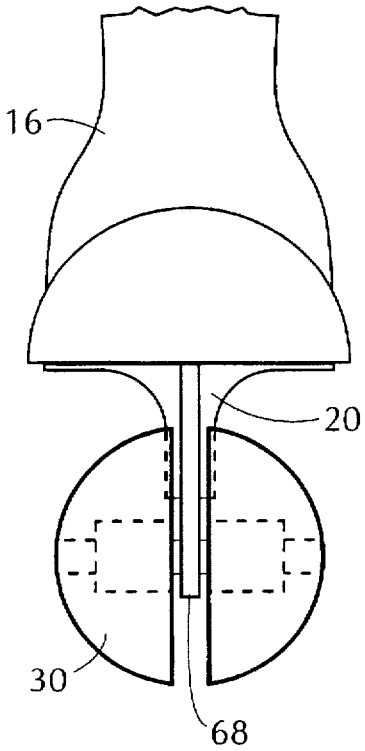
FIG. 4
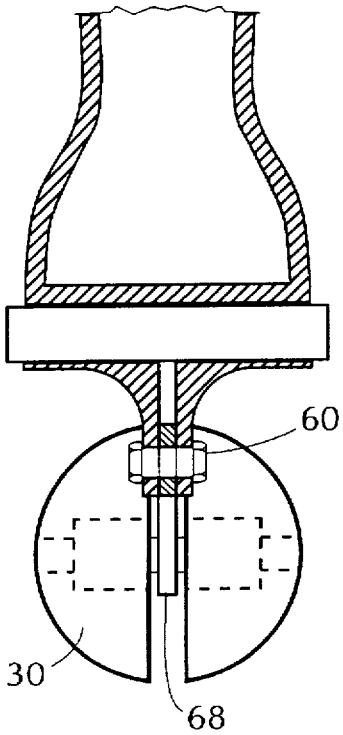
FIG. 5

ROLLER SKATE WITH BRAKE

This application is a continuation-in-part of application Ser. No. 08/657,967, filed Jun. 5, 1996, which is a continuation-in-part of application Ser. No. 08/472,382 filed Jun. 7, 1995, U.S. Pat. No. 5,685,550, the disclosures of which are hereby incorporated by reference.

This invention relates to roller skates, particularly of the in-line type, where a plurality of wheels are aligned in a linear array. More particularly the present invention is directed to in-line roller skates having superior performance capabilities over prior art in-line roller skates as to turning and stopping.

FIELD OF THE INVENTION

Roller skates, particularly of the in-line type which have a single linear array of wheels, are presently very popular and in wide use. In fact, one area of increasing popularity for in-line roller skates is in the use of such skates to play "roller"hockey. These skates tend to replicate the type of skating experienced with ice skates. One problem with in-line roller skates, as with all roller skates, is providing an effective provision for stopping. One widely used stopping device for roller skates is a rubber bumper extending downwardly at the front or rear of the skate. To stop forward skating motion, the skater tilts the toe or heel down to cause the bumper to contact the skating surface to provide friction and resistance to the forward motion of the skater.

However, in ice skating, a popular way of stopping forward motion is known as the hockey stop. In a manner similar to the use of skis, the skater makes a sharp turn to the side and the blade of the ice skate is turned transversely to the forward direction of the skater. The skate blade, now positioned transverse to the previous direction of movement, slides along and digs into the ice to provide a quick stopping action.

Another difference between in-line roller skates and ice skates is that present in-line skates provide multiple wheels all positioned at the same level so that the full array of wheels are in contact with the skating surface. Also, typically, some in-line roller skates are provided with wheels which are substantially short cylindrically shaped wheels or barrel shaped to provide a relatively wider surface area of contact with the skating surface. Other in-line roller skate wheels, while having a wheel profile which provides a point contact, does so in a manner which limits the angle with the skating surface which the skate can safely be employed. These factors tend to limit the ability of a skater using such prior in-line skates to make as sharp a turn as can be executed with ice skates.

Because conventional in-line roller skates have somewhat limited turning capabilities, stopping is usually accomplished by depressing the toe or heel to place the rubber bumper in contact with the ground to arrest forward momentum. If a skater is traveling at a high rate of speed and needs to stop quickly, often such quick stops cause the skater to fall forward. Most in-line skaters wear protective gear such as helmets, knee and elbow pads and hand pads to cushion these body parts in the event of a fall. Despite the wearing of these types of protective equipment many serious injuries occur.

The present invention provides a safer and quicker way of stopping which will eliminate many of the injuries sustained by a forward head long fall. The present invention also provides the ability to execute sharper turns than can be executed with prior art in-line roller skates.

Some in-line roller skates use a braking device which attempts to duplicate the hockey stop. One such braking device is disclosed in U.S. Pat. 4,618,158. In this patent an in-line skate is disclosed for use by figure skaters. A pair of in-line wheels at the toe and heel area are rotatably secured by carrier yoke supports to a mid-section support depending from a foot plate. The yoke supports are able to rotate in a direction transverse to, and about an axis parallel to, the skaters foot in a toe to heel direction. A braking mechanism is provided which includes a non-round braking surface in an axial extension in a housing rotatably secured to each yoke support. A spring urges a ball bearing against the non-round surface to provide a retarding force to the rotation of the yoke supports as a function of the degree of rotation. Wheel carrier yokes extend from opposite ends of the brake yoke supports. Auxiliary rollers on opposite sides of the main rollers, defining an extension of the surface of the main spherical rollers, are attached to the pair of main spherical rollers.

When the main rollers rotate about a longitudinal front to rear axis in a hockey stop motion, the auxiliary rollers, which are barrel shaped, contact the ground and support the skate. The rotation in this transverse direction activates the braking action to resist the prior forward motion of the skater. This skate is relatively complex, limits the number of wheels that can be used and is relatively costly to fabricate.

A brake and wheel for in-line roller skates is also disclosed in U.S. Pat. No. 5,312,165. This construction uses slip discs on a retainer ring forming the skate wheels. The discs provide a transverse braking skid to provide a friction engagement with the main support structure while the skate moves in the transverse direction.

U.S. Pat. No. 5,246,236 discloses a roller skate wheel for providing rolling action in forward and lateral directions. The main rollers are provided with secondary rollers which rotate about axes transverse to the longitudinal axis of rotation of the main rollers. Metal friction applying brakes contact the secondary rollers. The friction applied to the secondary rollers controls resistance to lateral rolling to provide a braking action.

Other skate and wheel constructions are disclosed in U.S. Pat. Nos. 5,199,727; 5,135,244; 4,838,564; 4,294,456; 3,936,061 and 2,166,767.

SUMMARY AND OBJECTS OF THE INVENTION

An in-line roller skate construction according to the present invention has substantially spherically shaped wheels attached to a foot receiving boot. The spherically shaped wheels provide more of a point contact between the wheels and the skating surface to more closely replicate the blade edge contact between an ice skate and the ice. All of the wheels are mounted for normal forward and rearward rotation.

Ice skates are not provided with a flat lower blade surface. Instead, the ice skate blades have a slight curved shape in the heel and toe area so that the heel and toe area curve upwardly. This blade feature provides an ability to make sharper turns than if the bottom of the blades were completely flat. In addition, in ice skating, especially on turns, only one edge of the blade is in contact with the ice. The present invention replicates these features of an ice skate blade to provide an in-line roller skate with superior turning capabilities over prior in-line skates where all the rollers are mounted so that they are all in contact with the skating surface.

To more closely replicate an ice skating action, at least a pair of center in-line wheels are mounted to extend further from the foot bed than the wheels on the heel and toe area. The interior wheels are also mounted for limited pivoting movement. In normal forward and rearward skating mode, as the skater moves, the tendency is to lean forward so that the foot also pivots forward. The result is that the boot pivots so that the front three wheels are in contact with the ground. On executing a turn, especially a sharp turn, the skater leans backward so that the boot also pivots back. The result is that as the boot pivots rearwardly the three rear wheels now contact the ground. The spherically shaped wheels also permit a skater to safely skate at a steeper angle with the ground surface thus allowing for sharper turn capability. This is the reason that the skate of the present invention provides an increased ability to execute turns.

The present invention has also recognized that increased stopping capability can be achieved on all types of skating surfaces by using only the interior wheels of the array for stopping purposes. Thus the support system has been designed to permit a rocking action to place only the interior wheels in contact with the ground when stopping.

It has been found after experimentation with a type of in-line roller skate as disclosed in parent application Ser. No. 08/657,967, that acceptable stopping capability in a hockey stop maneuver can be achieved without using an internal braking mechanism. The material for the wheels, a high impact engineering thermoplastic material resistant to wear and abrasion, exhibits sufficient frictional drag on numerous types of skating surfaces, e.g. concrete, asphalt and specially prepared surfaces for competition skating, during a hockey stop maneuver. Thus it has been found that with the interior wheels (i.e., two or more interior wheels) in contact with the skating surface a hockey stop maneuver can be successfully employed.

Accordingly, it is an object of the present invention to provide an in-line roller skate with superior quick stopping capability.

It is a further object of the present invention to provide an in-line roller skate with which a skater can stop by executing what is known as a hockey stop.

A still further object of the present invention is to provide an in-line roller skate which more closely replicates the superior turning ability of ice skates.

Yet, another object of the present invention is to provide an in-line roller skate which is safer to use and which would be less prone to result in serious injuries due to falls.

These and other objects and advantages of the present invention will be more readily ascertainable with reference to the following specification and drawings.

BRIEF DESCRIPTION OF THE DRAWINGS

FIG. 3 is a view similar to FIGS. 1 and 2 showing only the two interior wheels in contact with the skating surface;

FIG. 4 is a partial elevational view taken along the line 4—4 in FIG. 1;

FIG. 5 is a fragmentary sectional view taken along the line 5–5 of FIG. 1;

DESCRIPTION OF THE PREFERRED EMBODIMENT

Figure 1:
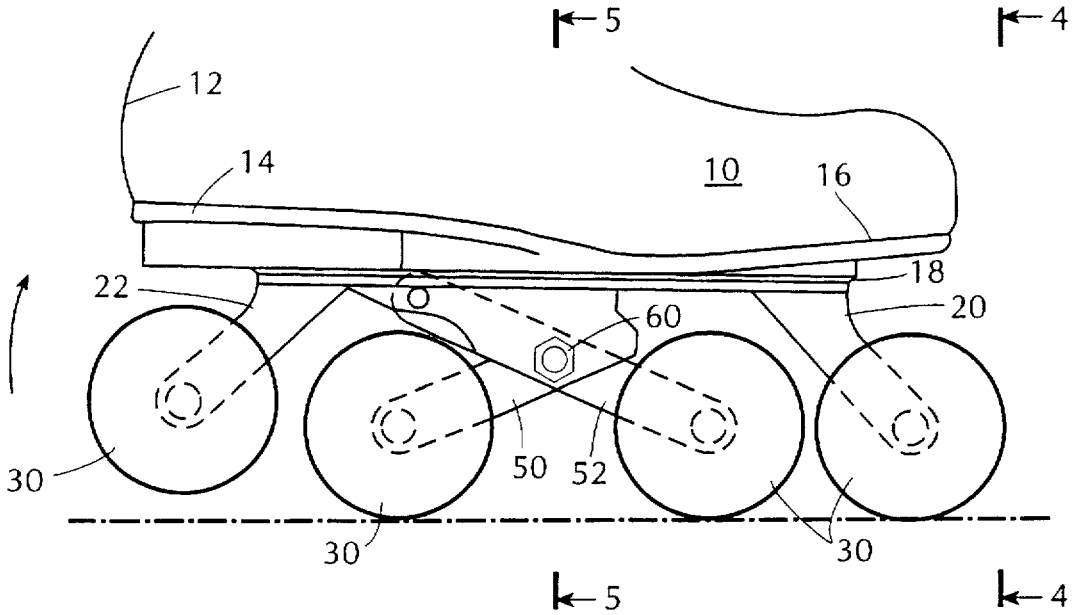
FIG. 1 is an elevational view showing a preferred embodiment of the in-line skate of the present invention with the toe wheel and two interior wheels in contact with the skating surface.
Figure 2:
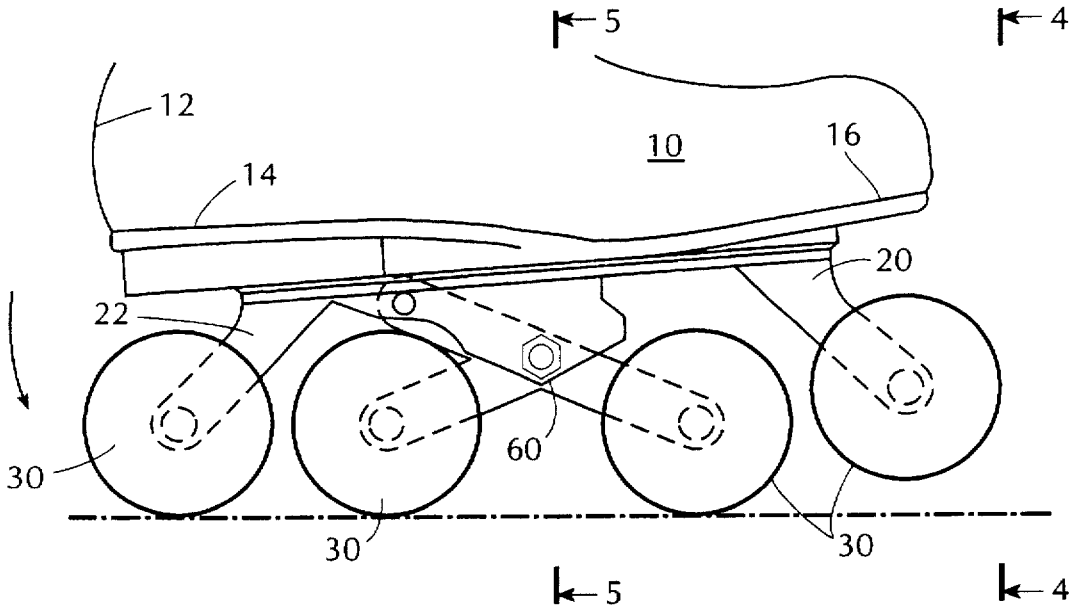
FIG. 2 is a view similar to FIG. 1 showing the heel wheel and two interior wheels in contact with the skating surface.
Figure 6:
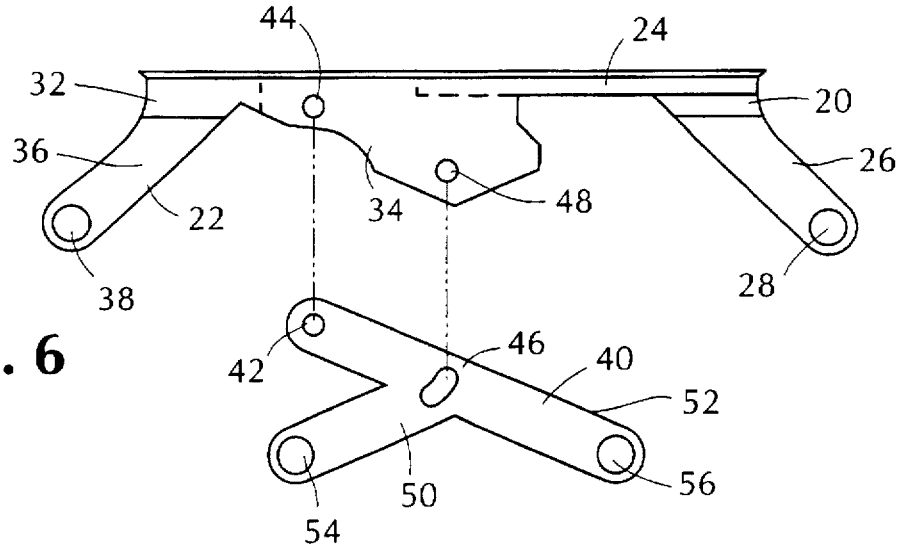
FIG. 6 is an exploded elevational view of the wheel mounting assembly.
Figure 7:
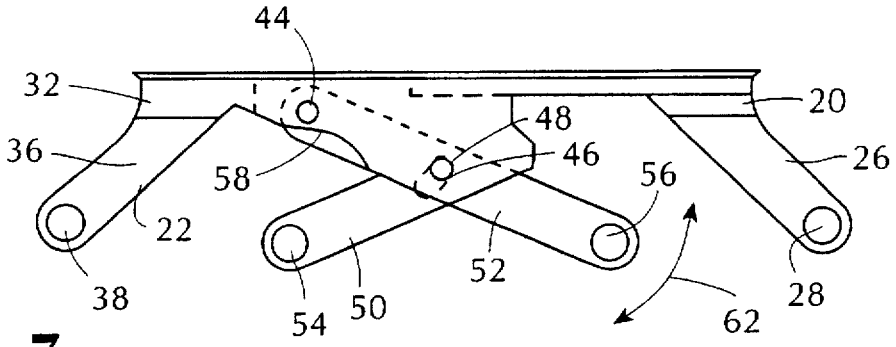
FIG. 7 is an elevational view of the wheel mounting assembly.

As seen initially in FIGS. 1–3, the skate 10 of the present invention includes a conventional shoe boot 12, having a heel area 14 and a toe area 16 to which is secured a sole plate 18 in any convenient manner, for example by rivets or any other suitable bonding. A toe wheel bracket mount 20 and a heel wheel bracket mount 22 are secured to the sole plate 18 in any convenient manner. As also seen in FIGS. 6 and 7 the toe wheel bracket 20 includes a base plate 24 and a forwardly extending arm 26 provided with a through bore 28 to accommodate the toe wheel assembly 30. Heel bracket mount 22 includes a base plate 32 from which extends a pair of side members 34 and a rearwardly extending arm 36 having a through bore 38 therethrough to accommodate the mounting of the heel wheel assembly 30.

A pivoting bracket 40 is mounted between the extending side members 34 of heel bracket mount 22 to accommodate the interior wheel assemblies 30. Pivoting bracket 40 may include a first bore 42 which aligns with bore 44 in side members 34 or a bore 46 which aligns with through bore 48 in side members 34. Pivoting bracket 40 also includes extending arms 50 and 52 which include through bores 54 and 56, respectively, to receive the interior wheel assemblies 30.

As best shown in FIGS. 6 and 7 pivoting bracket 40 is pivotally mounted in any convenient manner, for example by a pivot axle 58 which extends through bores 42 and 44 or by a pivot axle 60 through bores 48 and 46. Pivot axles 58 or 60 may be in the form of rivets, nut and bolt assemblies or other suitable means for pivotably connecting pivoting bracket 40. Accordingly, pivoting bracket 40 may be pivotably mounted in any convenient manner. According to preferred embodiments, pivoting bracket 40 is mounted by a nut and bolt assembly which extends through bores 42 and 44 or through a nut and bolt assembly which extends through bores 48 and 46.

As shown in FIG. 7 with this arrangement, the pivoting bracket 40 can pivot about the pivot axle 58 in the directions indicated by the arrow 62 in FIG. 7 or about pivot axle 60 as shown in FIG. 3.

While a preferred embodiment uses a pivoting bracket such is not necessary as the interior wheels may be fixed. In such an embodiment the interior wheels are fixed at a lower elevation than the toe or heel wheels.

According to another preferred embodiment, two or more of the elements may be constructed as a single element. Advantageously, the sole plate 18, base plate 24, base plate 32, side members 34, extending arms 36 and 26 are in the form of a single piece. Even better, the single piece may also include shafts 68 extending through bores 28 and 38. According to yet another embodiment, pivoting bracket 40 may be a single piece that incorporates extending arms 50 and 52 and bores 42, 46, 54 and 56. Even better, the single piece pivoting bracket 40 may also include shafts 68 through bores 54 and 56.

Figure 8:
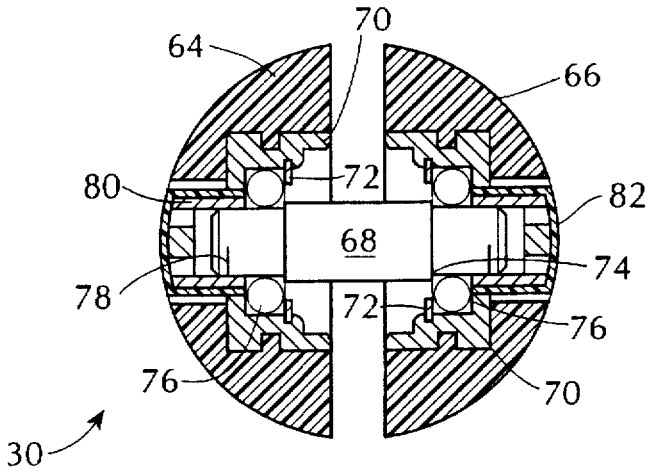
FIG. 8 is a partial cross sectional view of a roller skate wheel of the present invention.

The substantially spherical wheel assemblies 30 are all of the same construction and are provided for the toe wheel, heel wheel and interior wheels. Each wheel assembly 30, see FIG. 8 as well, is identical in construction and includes a pair of semispherical wheel halves 64 and 66 formed of a molded engineering thermoplastic material secured for rotation about a shaft 68 in each of the bracket through bores 28, 38, 54 and 56. Each wheel assembly includes an internal bearing housing 70 provided with a bearing ring 72. Shaft 68 includes a bearing shoulder 74 and roller bearings 76 are provided to abut against bearing ring 72 and bearing shoulder 74. Shaft 68 is threaded at each end as at 78 to threadably receive a threaded retainer cap 80 to retain each wheel half 64 and 66 on the shaft 68. A cover cap 82 is provided to frictionally fit over retainer cap 80 so that the exterior surfaces of each wheel half have a semi-spherically exterior surface.

With the pivoting arrangement provided by pivoting bracket 40 the interior wheel assemblies 30 can pivot with respect to the boot 12. As best seen in FIG. 3, toe wheel bracket 20 and heel wheel bracket 22 are of a length so that the toe and heel wheel assemblies are elevated slightly off the ground or skating surface. In actuality during skating use the skater's boot pivots in the direction of the broad arrows in FIGS. 1 and 2 to either place the toe wheel in ground contact along with the interior wheels, see FIG. 1, or the heel wheel in ground contact along with the interior wheels, see FIG. 2.

Figure 11:
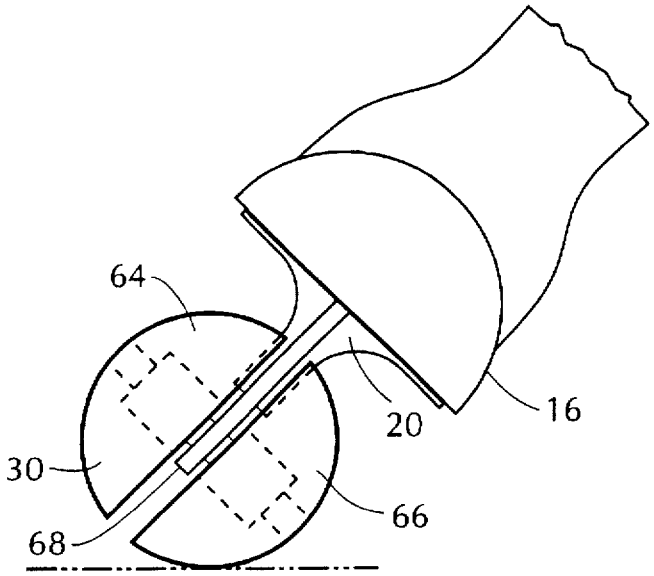
FIG. 11 is a fragmentary elevational view of the roller skate wheel of the present invention at an angle to the skating surface.

In typical skating in a forward direction the skater tends to lean forward so that the toe wheel and the two intermediate wheels as depicted in FIG. 1 are normally in contact with the ground. When it is desired to execute a turn, as the skater turns the boot in the direction of the turn, the skater's body leans back slightly so that the heel and heel wheel pivot downwardly, elevating the toe wheel in the position of FIG. 2. In addition on executing a turn the skater's body leans in the direction of the turn so that the foot pivots about the vertical axis, as seen in FIG. 11, so that the contact between the wheel assembly and the ground or skating surface is only on one-half of the two part wheel assembly. Because of the spherical shape of the wheel assembly point of contact is maintained with the skating surface as the spherical-like surface provides multiple uniform tangent points between the wheel surface and the ground at varying angles. Thus no matter how steep or severe an angle the skater's body and feet form with the ground, the wheeled contact angle remains uniformly constant. This enables the skater to make a more severe or sharper turn than could be made with prior in-line skates.

Figure 9:
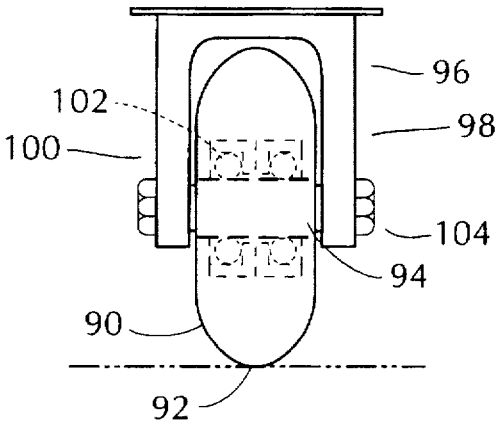
PRIOR ART FIG. 9
FIG. 9 is a fragmentary elevational view of a prior art in-line roller skate wheel in an upright position.
Figure 10:
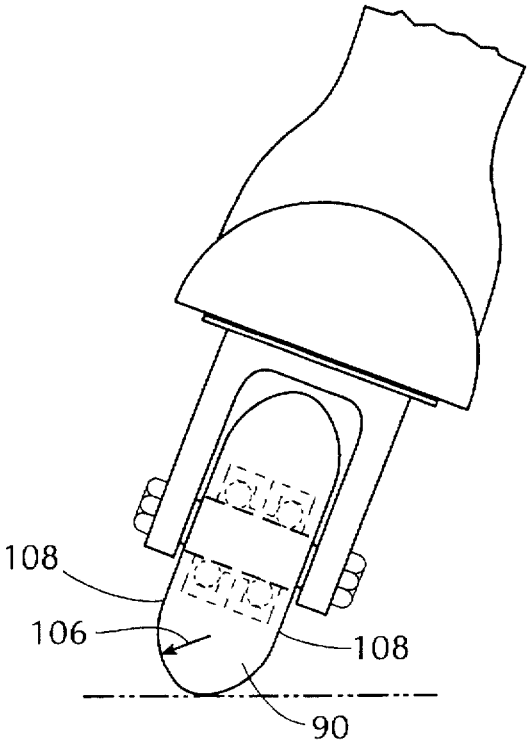
PRIOR ART FIG. 10
FIG. 10 is a fragmentary elevational view of the prior art in-line roller skate wheel at an angle to the skating surface.

Reference is now made to FIGS. 9 and 10 which show typical prior in-line skate arrangements. In these arrangements a wheel 90 which has a rounded ground engaging surface 92 is mounted on a shaft 94 journalled within a support structure 96 having legs 98 and 100 on each side of the wheel 90. Typically the wheel is mounted by bearings 102 on shaft 94 and the wheel assembly is secured by end nuts 104 within the support structure 96. Because of the more sharply radiused sides of the wheel indicated by the arrow 106 in FIG. 10, there is a limit to the angle from the vertical with which such a skate can be safely employed. Additionally, this style of wheel almost universally used in prior in-line skates, has a radius of curvature for the same overall wheel diameter less than a wheel of the present invention. Thus, as shown in FIG. 10, the maximum angle from the vertical at which the skate can be safely employed is one where the radiused portion 106 of the wheel remains in contact with the ground. Any steeper angle bringing the flatter side walls 108 of the wheel 90 into contact with the ground will result in an immediate skid out and a fall. In contrast, a steeper angle may be obtained with the semi-spherical wheel construction of the present invention, as shown in FIG. 11, so that a much steeper angle can be utilized resulting in the ability to make sharper and more precise turns.

When a skater desires to stop by executing the hockey stop maneuver, the skater executes a sharp transverse turn. At the same time the skater's body will lean in the direction of the turn so that the skates will pivot about the vertical axis to the position as may be depicted in FIG. 11. It has been found that the friction between the high impact engineering thermoplastic material with which the wheels are made and typical ground skating surfaces, such as concrete, asphalt and specially prepared competition surfaces, is sufficient to arrest the forward momentum of the skater. When executing the stopping maneuver using the hockey stop, the two interior wheels, as shown in FIG. 3, are the ones that engage the ground surface with the toe and heel wheels being elevated. It is thus apparent that most of the frictional wear on the wheel surfaces will occur to the two interior wheels and when the wheels are sufficiently worn the toe and heel wheels may be exchanged for the two interior wheels until wheel replacement is necessary. It is thus seen that the present invention provides a roller skate which has the ability to more closely replicate an ice skate both as to an increased ability to navigate sharper turns and also to allow for rapid and safer stopping maneuver.

The disclosed embodiments are provided by way of illustration and not limitation as further modifications may be made without departing from the spirit and scope of the present invention as defined in the following claims.

What is claimed is:

1. An in-line roller skate having a plurality of wheels rotatably mounted in a linear array to a foot receiving boot having a toe and heel area comprising:

a toe wheel rotatably mounted on a bracket depending from said toe area of said boot, a heel wheel rotatably mounted on a bracket depending from said heel area of said boot, a plurality of interior wheels rotatably mounted on a bracket depending from said boot between said toe and heel wheels, said bracket mounting said plurality of interior wheels being pivotally mounted with respect to said boot whereby said plurality of interior wheels may pivot with respect to said boot.

2. The in-line roller skate according to claim 1 wherein said toe and heel wheels are mounted at a higher elevation than said plurality of interior wheels.

3. The in-line roller skate according to claim 2 wherein said wheels are substantially spherical in shape.

4. The in-line roller skate according to claim 2 wherein each said wheel comprises a pair of substantially semi-spherically shaped wheel members mounted for rotation on a shaft member carried by each said bracket.

5. The in-line roller skate according to claim 1 wherein said wheels are substantially spherical in shape.

6. The in-line roller skate according to claim 1 wherein each said wheel comprises a pair of substantially semi-spherically shaped wheel members mounted for rotation on a shaft member carried by each said bracket.

7. An in-line roller skate chassis having a plurality of wheels rotatably mounted in a linear array and adapted to be mounted to a foot receiving boot having a toe and heel area comprising:

a toe wheel rotatably mounted and depending from said toe area, a heel wheel rotatable mounted and depending from said heel area, a plurality of interior wheels rotatably mounted on a bracket between said toe and heel wheels, said bracket rotatable mounting said plurality of interior wheels being pivotally mounted with respect to said chassis whereby said plurality of interior wheels may pivot with respect to said chassis, and said toe and heel wheels being mounted at a higher elevation than said plurality of interior wheels.

8. The in-line roller skate according to claim 7 wherein said wheels are substantially spherical in shape.

9. The in-line roller skate according to claim 7 wherein each said wheel comprises a pair of substantially semi-spherically shaped wheel members mounted for rotation on a shaft member carried by each said bracket.

10. An in-line roller skate having a plurality of wheels in a linear array mounted to a foot receiving boot having a toe and heel area comprising;

a toe wheel rotatably mounted on bracket means in said toe area, a heel wheel rotatably mounted on bracket means in said heel area, a plurality of interior wheels rotatably mounted on bracket means between said toe and heel wheels, and said bracket means being pivotally mounted with respect to said boot so that said boot can pivot in use to maintain either said toe wheel and said interior wheels in contact with a skating surface or said heel wheel and said interior wheels in contact with said skating surface during appropriate skating maneuvers.

11. The in-line roller skate according to claim 10 wherein said plurality of interior wheels are mounted so as to extend further from said boot than said toe and heel wheels.

12. The in-line roller skate according to claim 10 wherein each said wheel comprises a semispherically shaped wheel element rotatably mounted on a shaft carried by said bracket means and wherein said bracket means is positioned between each semispherically shaped wheel element.

13. The in-line roller skate according to claim 10 wherein each said plurality of wheels are substantially spherical in shape.

* * * * *